United States Patent [19]

Aston et al.

[11] 4,220,420

[45] Sep. 2, 1980

[54] SEALING MEANS, PRIMARILY FOR A SLUICE GATE

[75] Inventors: Raymond Aston; David T. Aston, both of Brierley Hill, England

[73] Assignee: Ham Baker & Company Limited, Warley, England

[21] Appl. No.: 946,021

[22] Filed: Sep. 26, 1978

[51] Int. Cl.[2] ..... E02B 7/54; E02B 7/28

[52] U.S. Cl. ..... 405/104; 49/436; 52/397; 52/766; 251/147; 251/187

[58] Field of Search ..... 405/104, 105, 106, 103; 52/397, 766; 251/147, 187, 203, 328; 49/436, 440, 466, 209

[56] References Cited

U.S. PATENT DOCUMENTS

| | | | |
|---|---|---|---|
| 2,643,521 | 6/1953 | Hatch | 405/106 |
| 3,190,408 | 6/1965 | Petterson | 52/766 |

FOREIGN PATENT DOCUMENTS

| | | | |
|---|---|---|---|
| 621477 | 10/1935 | Fed. Rep. of Germany | 405/104 |

*Primary Examiner*—Alexander Grosz

*Attorney, Agent, or Firm*—Merriam, Marshall & Bicknell

[57] ABSTRACT

A sealing arrangement primarily for a sluice gate which comprises a frame and a door movable between an open position and a closed position in which it closes an opening in the frame and sealing faces of the door and the frame are in sealing engagement to prevent the flow of liquid through the opening. The sealing arrangement comprises an intermediate wedge section strip interposed between two side strips having inclined planar faces in contact with the inclined planar side faces of the intermediate strip. The intermediate strip is either arranged to bear against the door or secured to the frame, and either one of the side strips is secured to the frame or both side strips are arranged to bear against the door respectively. Adjusting means, for example a series of bolts and nuts, extend through apertures in the three strips and are operable to apply forces to the side strips to press them inwardly towards the intermediate strip thereby to cause either the intermediate strip or the two side strips to move relative to the fixed side strips or the fixed intermediate strip, respectively, under the effect of their co-operating inclined faces whereby the door is urged towards the frame and the sealing face of the door is pressed into sealing engagement with the sealing face of the frame.

16 Claims, 10 Drawing Figures

SEALING MEANS, PRIMARILY FOR A SLUICE GATE

FIELD OF THE INVENTION

This invention relates to sealing arrangements in which a seal is provided between two members by the mutual contact of two sealing faces of the respective members.

The invention has been devised primarily in connection with sluice gates of the kind comprising a frame to be mounted in or adjacent to an aperture or in a channel and defining an opening for the passage of liquid flowing through the aperture or along the channel, and a door having means operable to move the door between a closed position in which sealing faces of the door and the frame are brought into sealing engagement thereby to close the opening and shut off the flow of liquid through the aperture or along the channel, and an open position in which the sealing faces are disengaged so that liquid is permitted to flow through the aperture or along the channel. In such a sluice gate the door and the frame constitute the said members of a sealing arrangement as referred to herein.

The invention will be particularly described in relation to sluice gates but there is no limitation in this regard as the invention has other applications, for example in valves.

It is important in a sluice gate that there is an effective seal between the door and the frame when the door is in its closed position, otherwise liquid would leak through the sluice gate. With conventional sluice gates, however, problems arise in ensuring that an effective seal is produced.

It is an object of the present invention to provide a sealing arrangement which is capable of providing an effective seal between the sealing faces of the members of the arrangement.

A particular aim of the invention is to provide a sealing arrangement in a sluice gate which is of a simple construction and has provision for easy and quick adjustment to provide an effective seal between the door and the frame when the door is closed.

SUMMARY OF THE INVENTION

According to a first aspect of the invention, we provide in a sealing arrangement comprising two members having respective sealing faces the mutual contact of which provides a seal between the members, and means for urging one of the members towards the other member thereby to press the sealing face of said one member into sealing engagement with the sealing face of said other member, the improvement wherein said means comprises at least two parts of which one is arranged to bear against or is connected to said one member and the other is fixed in relation to said one part, the two parts having co-operating planar faces at an inclination to a first direction, and adjusting means operable to apply a force to said one part in a second direction perpendicular or substantially perpendicular to said first direction and extending transversely through said faces to cause said one part to move in said first direction relative to said other, fixed part under the effect of the co-operating faces, thereby to urge the said one member in said first direction towards said other member.

In a preferred embodiment, one of the two parts comprise two spaced portions having the other part disposed between them with its side faces co-operating with the opposed faces of the two portions, at least one pair of said co-operating faces being planar faces disposed at an inclination to said first direction, and the adjusting means is operable to apply forces to the two portions in directions towards one another and perpendicular or substantially perpendicular to said first direction, thereby to press the two portions inwardly against the intermediate part so that the two parts are moved relative to one another in said first direction under the effect of the inclined faces. The other pair of co-operating faces may be parallel to said first direction but preferably are also at an inclination thereto, the intermediate part being of wedge form.

The intermediate part may be fixed and the said portions may be arranged to bear against or may be connected to the said one member of the sealing arrangement, but preferably one of said portions is fixed and the intermediate part is arranged to act on said one member.

In the preferred embodiment the adjusting means comprises a screw-threaded element extending through apertures in the said portions and the intermediate part and having a head or nut at one end engaged with one portion and a nut at the other end engaged with the other portion, whereby tightening of the latter nut urges said portions towards one another to cause the relative movement between the said portions and said intermediate part.

The parts of the sealing arrangement may be of elongate form, in which event a number of said adjusting means will be provided at intervals along the parts.

The said other member of the sealing arrangement may comprise a channel member having a base, two side walls extending from the base and flanges extending inwardly from the side walls towards one another; a sealing element mounted in the channel member for movement relative thereto in a direction perpendicular or substantially perpendicular to the base but being retained therein by the said flanges, said sealing element having a portion projecting from the mouth of the channel and providing the sealing face of the said other member; and resilient means disposed between the base of the channel member and the sealing element whereby, in use, the sealing element is resiliently urged outwardly by said resilient means to press its sealing face into engagement with the sealing face of the said one member of the sealing arrangement.

Thus, the said means of the sealing arrangement acts to press the said one member thereof into engagement with a resiliently mounted member and this further enhances the effectiveness of the seal between the two members of the sealing arrangement. The pressure with which the said one member is urged into contact with the resiliently mounted member can be easily and quickly varied as required to produce an effective seal between the members simply by operating the adjusting means.

Where the parts of the said one member of the sealing arrangement are of elongate form, the channel member and the sealing element will also be of such form and will be parallel to said parts.

According to a second aspect of the invention there is provided a sluice gate which incorporates a sealing arrangement according to the first aspect of the invention, the door constituting the said one member of the arrangement and the frame constituting the said other member, and the said means of the sealing arrangement being arranged to act on the door when the latter is closed, to urge the sealing faces of the door and the frame into sealing engagement.

In a sluice gate the door is required, when in its closed position, to be in sealing engagement with the frame along both sides of the door (and also along the bottom and in some cases along the top of the door). A sealing arrangement according to the present invention is preferably provided at both sides of the door, the opposite side portions of the door constituting the said one members of the respective arrangements and the corresponding sides of the frame constituting or having mounted thereon the said other members of the respective arrangements and the said adjusting means of the arrangements being operable to urge the respective side portions of the door into sealing engagement with the frame.

BRIEF DESCRIPTION OF THE DRAWINGS

The invention will now be described, by way of example, with reference to the accompanying drawings.

In the drawings.

DESCRIPTION OF THE PREFERRED EMBODIMENTS

Figures 1, 2:
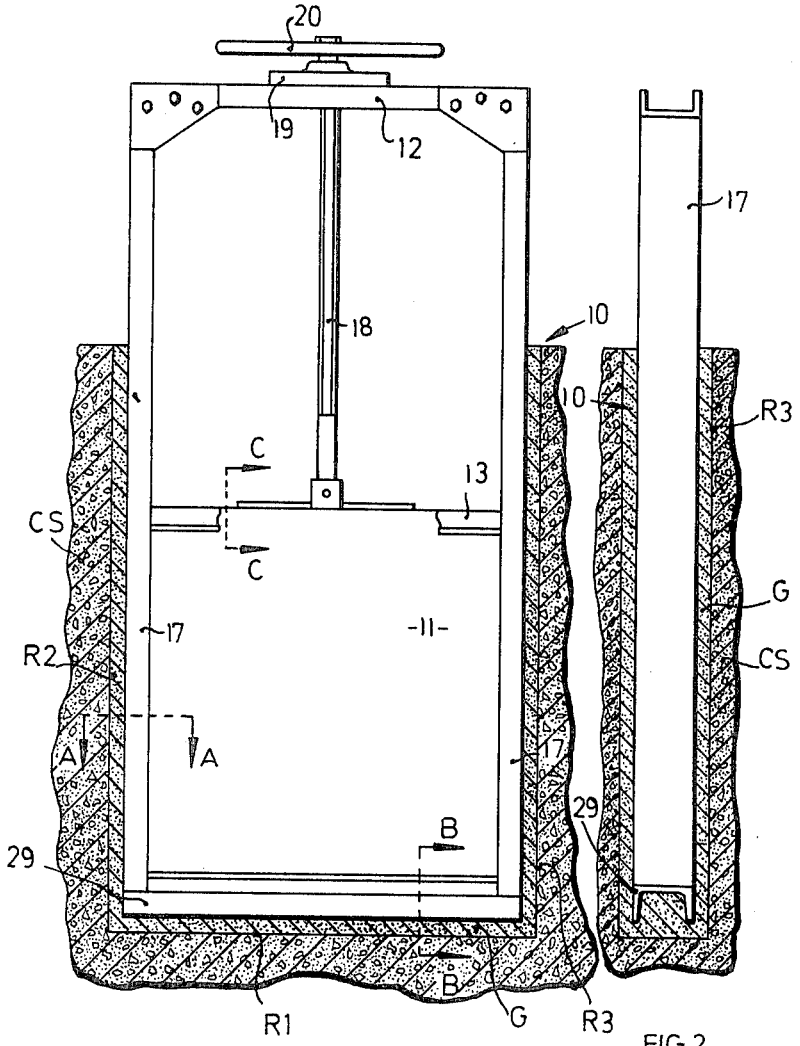
FIG. 1 is a front elevation, partly cut away, of a sluice gate incorporating one form of sealing arrangement embodying the invention, the sluice gate being shown mounted in a channel defined by a concrete surround so as to control the flow of water along the channel.
FIG. 2 is a side elevation of the sluice gate.

The sluice gate illustrated in the drawings basically comprises a rectangular metal frame 10 and a rectangular door 11. The frame comprises two vertical channel section members 17 at opposite sides thereof, a lower cross member 29, an upper cross member 12 and an intermediate cross member 13. The cross members 29 and 13 and the lower parts of the side members 17 together form a rectangular opening in the lower part of the frame, and the frame is intended to be mounted either in a concrete surround defining a channel or on a wall defining an aperture so that water (or other liquid) flowing along the channel or through the aperture will pass through this opening in the frame.

Figure 9:
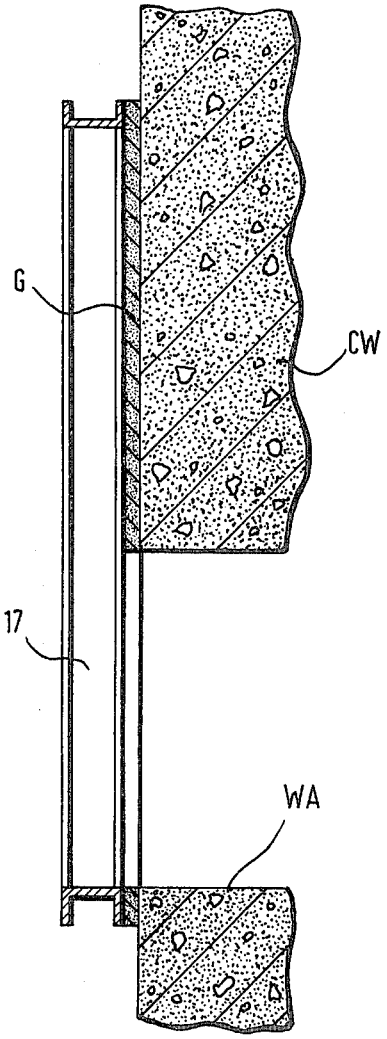
FIG. 9 shows the sluice gate, with its door and other parts omitted, mounted on a wall to control the flow of water through an aperture in the wall.
Figure 10:
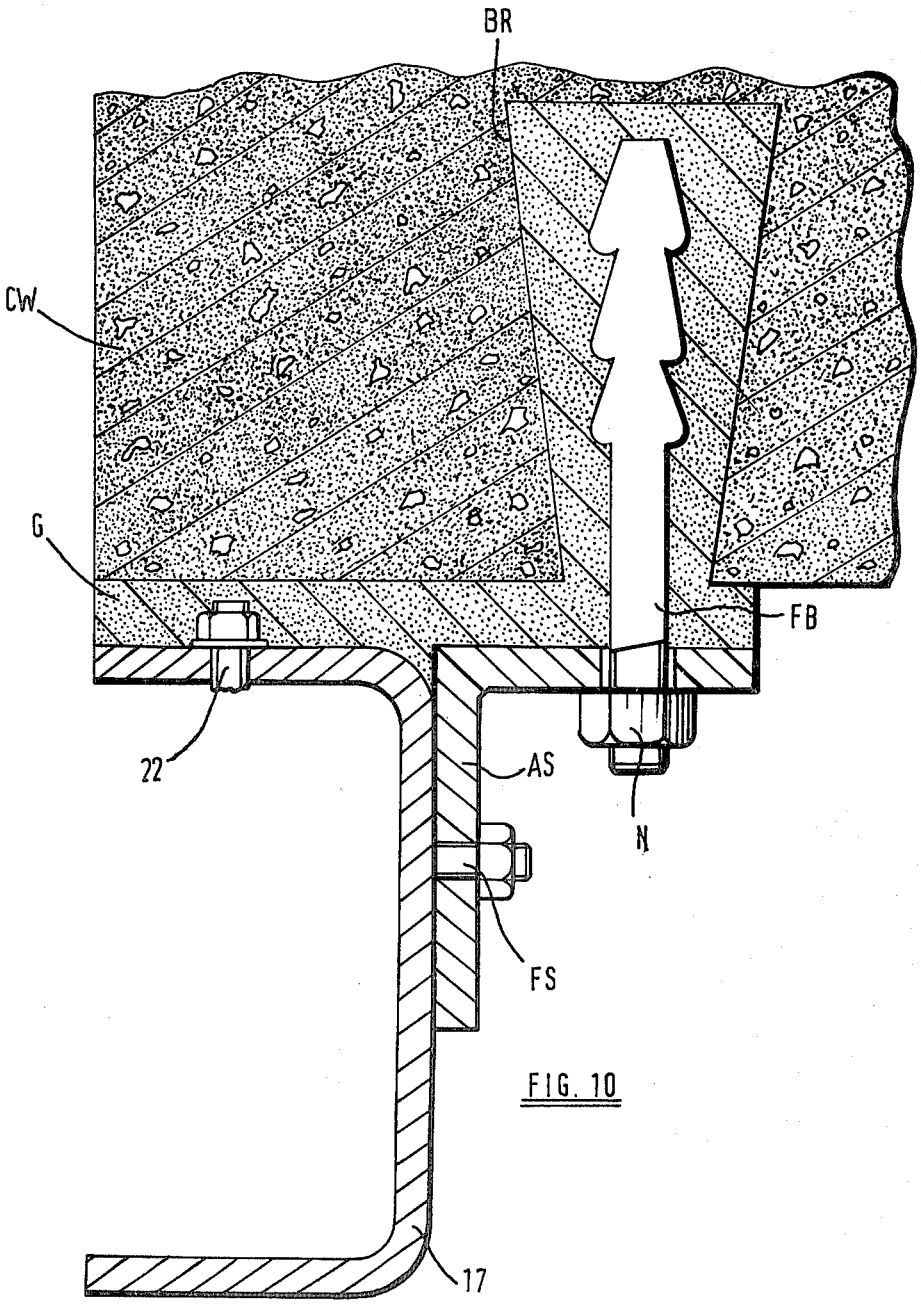
FIG. 10 is a partial section through the sluice gate shown in FIG. 9, similar to the section of FIG. 4 but with parts omitted.

In FIGS. 1 to 6 of the drawings the frame is shown mounted in a concrete surround CS defining a channel having a bottom wall (designated W1 in FIG. 5) and two side walls (one of which is designated W2 in FIG. 4), an upper part of the frame projecting from the channel. The lower cross member 29 and lower parts of the side members 17 are located in recesses R1, R2 and R3 formed in the bottom and side walls of the concrete surround and are embedded in concrete grout G filling these recesses. FIGS. 9 and 10 show the frame mounted on a concrete wall CW defining an aperture WA, the rectangular opening in the lower part of the frame being in register with this aperture. The frame is secured to the wall at opposite sides of the aperture by two vertical rows of indented foundation bolts FB which pass through apertures provided at intervals along two respective vertical angle section members AS and carry nuts N at their outer ends. The vertical channel section members 17 are secured to the respective angle section members AS by rows of screws FS. On installation of the sluice gate the frame is held in position relative to the wall CW with a gap between the frame and the wall, this gap being closed by shuttering around the outside of the frame and around the inside of the opening in the lower part of the frame. The foundation bolts FB extend into recesses BR in the wall. Concrete grout is introduced into the gap so that it fills the gap and also enters the recesses and the grout, when it has set, provides a firm support for the sluice gate on the wall and a firm anchor for the foundation bolts. The nuts N of the foundation bolts are then tightened up, if necessary, to secure the sluice gate firmly in position.

The door 11 is movable relative to the frame 10 between an open position in which it lies alongside the upper part of the frame and is clear of the lower opening in the frame so that water can flow through the opening either along the channel in the concrete surround CS or through the aperture in the concrete wall CW, and a closed position, as shown in the drawings, in which its rear face is in sealing engagement with the lower part of the frame thereby to close the opening and shut off the flow of water along the channel or through the aperture.

The door 11 is guided for movement in a vertical plane by the vertical channel section members 17 at opposite sides of the frame 10. Raising and lowering of the door are effected by a screw threaded spindle 18 connected to the door and passing through a screw-threaded sleeve 19 mounted on the upper cross member 12 of the frame. In the embodiment illustrated the spindle 18 is operable by a hand wheel 20 (FIG. 1) although it may be operable by an electric, pneumatic or hydraulic actuator. In an alternative arrangement the spindle is axially fixed relative to the frame but turnable by a handle or other means and passes through a screw-threaded sleeve on the door.

Figure 4:
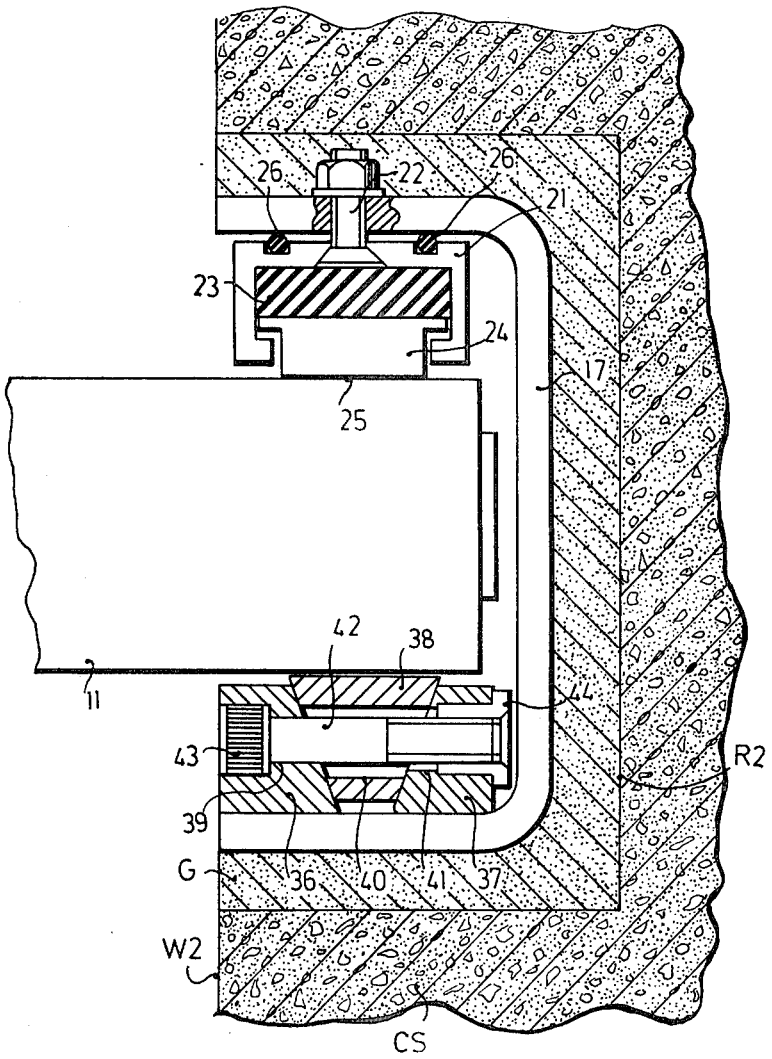
FIG. 4 is a section on the line A—A of FIG. 1 showing the sealing arrangement in detail.

Referring to FIG. 4, the vertical channel section member 17 at each side of the frame is provided at the rear face of the door 11 with a sealing means comprising a vertical channel 21 of rigid polyvinylchloride or other suitable plastics material having a base, two side walls extending from the base and inturned flanges extending from the side walls. The channel 21 is secured to the vertical channel section member 17 by screws 22 provided at intervals along the channel 21, the screws passing through holes in its base and the member 17 and being fitted with nuts. Disposed in the channel 21 is a sealing member 24 of high density polyethylene or other suitable plastics material which is retained in the channel by the inturned flanges thereof and has a portion projecting from the channel and providing a smooth and flat hard-wearing sealing face 25. A strip 23 of resilient foamed plastics material such as "Neoprene" sponge is interposed between the base of the channel 21 and the sealing member 24 so as resiliently to urge the latter outwardly in a direction away from the base of the channel.

The vertical channel section members 17 at the sides of the frame are provided at the front face of the door with means for urging the side portions of the door into engagement with the sealing faces 25 of the two sealing members 24. These means comprise, for each member 17, two spaced strips 36, 37 of polyvinylchloride or any other appropriate material having opposed planar faces which are inclined so as to converge in a direction towards the bottom of the channel formed thereby, and a strip 38 of wedge shape in cross section and of high density polyethylene or any other appropriate material. The strip 36 is secured by screws (not shown) at intervals along its length to the member 17, and the strip 38 is disposed between the strips 36 and 37 with its converging planar side faces in contact with the converging faces of the strips 36 and 37. At intervals along the assembly the strips 36, 37 and 38 have aligned transverse apertures 39, 40 and 41. These apertures receive a bolt 42 which has a head 43 at one end accommodated in a recess at the outer end of the aperture 39 in the strip 36, and a screw-threaded portion at the other end engaged by a nut 44 which has a sleeve portion received in the aperture 41 in the strip 37 and a head which bears against the outer side face of the latter. The bolts 42 act to hold the otherwise free strip 37 so that both it and the strip 36 are fixed relative to the channel member 17. The aperture in the intermediate wedge section strip 38 is of a larger diameter than the bolt shank to permit movement of the strip in directions perpendicular to the shank relative to the latter and to the strips 36 and 37.

The arrangement is that with the door closed, tightening of the nuts 44 urges the strips 36 and 37 towards one another thereby squeezing the intermediate strip 38 between them. As a result the intermediate strip is moved relative to the strips 36 and 37 and towards the door 11 by the action of the two pairs of co-operating, inclined side faces of the strips, and urges the relevant side portion of the door towards the adjacent sealing means 21, 23, 24. The rear face of the door is thereby pressed into sealing contact with the two sealing faces 25 of the sealing elements 24. By appropriate adjustment of the bolts 42 and the nuts 44 an effective seal can be produced between each side portion of the door and the associated sealing element 24. The effectiveness of the seal is enhanced by the resilient mounting of the element 24. The pressure of water on the front face of the door also assists the sealing engagement but the invention is also applicable to a sluice gate which is arranged so that the water presses on the rear face of the door when its flow is shut off.

It will be seen that the two strips 36, 37 constitute two portions of one part of the adjustable means and the strip 38 constitutes the other part of the adjustable means which is movable to urge the door in a first direction towards the adjacent sealing means 21, 23, 24, the co-operating side faces of the strips being inclined to said first direction and such movement of the part 38 being produced by the inwardly directed forces applied to the portions 36, 37 by the bolts 42 and nuts 44 in directions perpendicular to said first direction.

The sealing means and the adjustable means at the sides of the frame extend to such a height that when the door is in the open position its lower portion still engages the sealing elements 24 and the strips 38. Thus, on lowering of the door into its closed position it presses the sealing elements 24 inwardly with respect to the channels 21 against the action of the resilient strips 23, the sealing elements being somewhat resiliently flexible so that they can bend as the door slides over them. The sealing faces 25 of the elements 24 are made smooth and flat so that they provide a good seal with the door. The faces of the strips 38 which contact the door are also smooth and flat so that both they and the faces 25 constitute anti-friction means for sliding of the door over them.

O-ring cord or rubber seals 26 are provided between the channels 21 of the sealing means and the vertical channel section members 17 of the frame.

Figure 7:
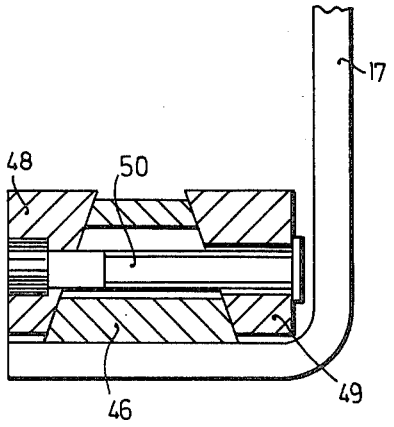
Figure 8:
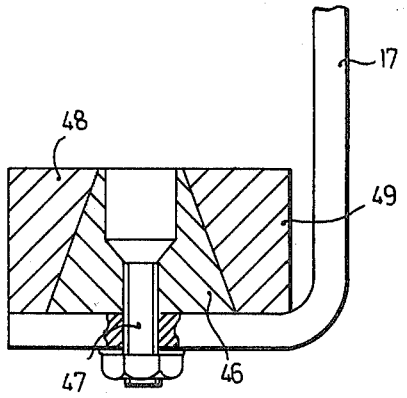

FIGS. 7 and 8 show a modification in which the adjustable means at each side of the door comprise a wedge section strip 46 of polyvinylchloride or any other appropriate material which is secured by nuts and bolts 47 at intervals therealong to one side of the relevant channel section member 17, and two strips 48, 49 of high density polyethylene or any other appropriate material which extend at opposite sides of the wedge section strip and have their opposed planar inner faces inclined and in contact with the side faces of the strip 46. An adjusting means 50 similar to the adjusting means 42, 43, 44 is provided at the other side of the channel section member 17. The arrangement in this case is that adjustment of the adjusting means 50 moves the strips 48, 49 relative to the fixed wedge section strip 46 so that they both act on the door.

Figure 6:
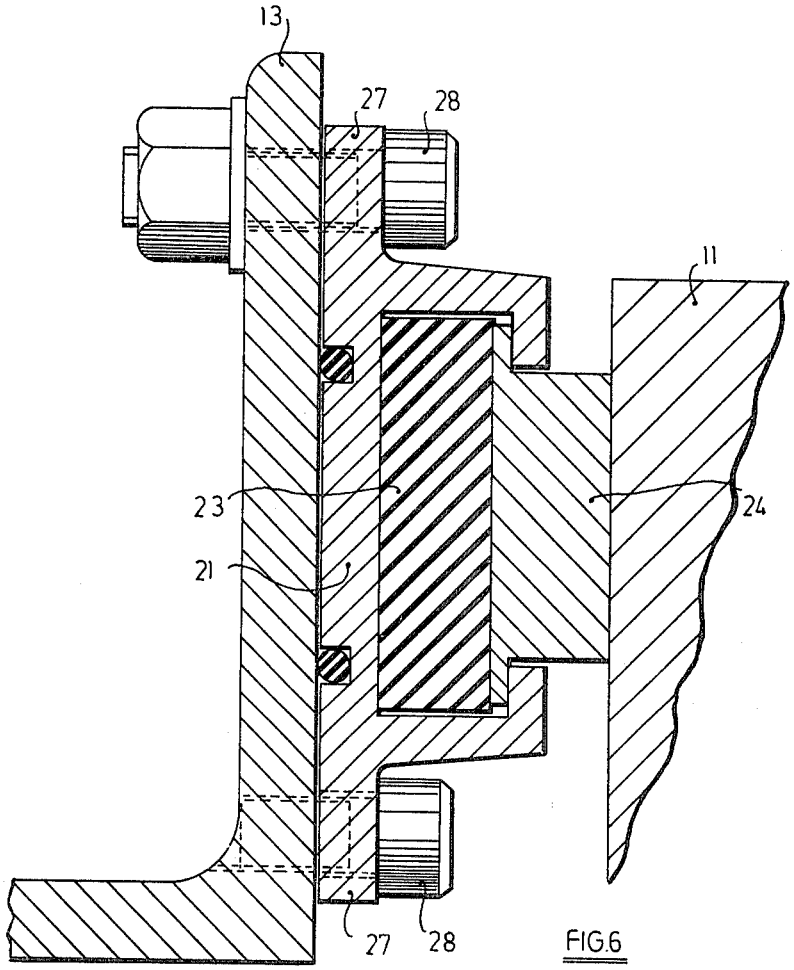
FIG. 6 is a section on the line C—C of FIG. 1, FIGS. 7 and 8 show a modification of the sealing arrangement, being cross sections taken at different locations along the arrangement.

Referring to FIG. 6, a further sealing means is provided along the intermediate cross member 13 of the frame for engagement with the upper part of the door 11 when the latter is in its closed position. This sealing means is arranged to engage the rear face of the door 11 and is basically of the same construction as the sealing means provided at the sides of the door, being given the same reference numerals, except that the channel 21 thereof is provided with flanges 27 to receive bolts 28 for securing the channel to the cross member 13.

Figure 5:
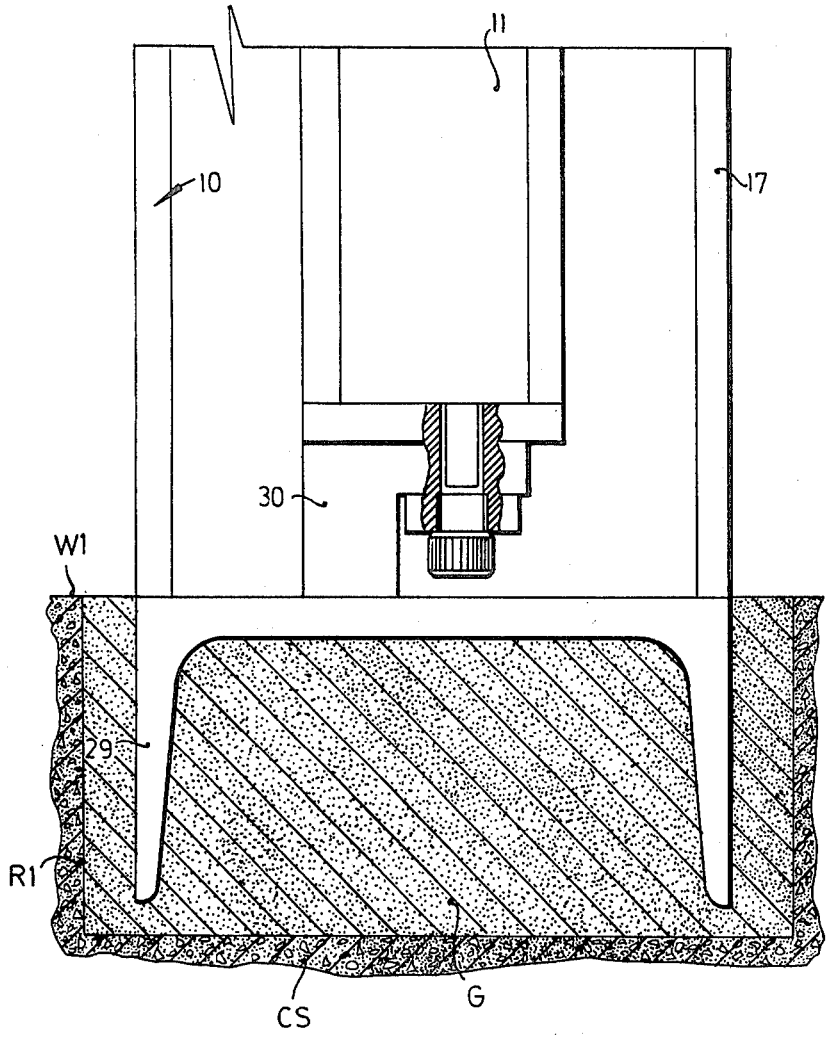
FIG. 5 is a section on the line B—B of FIG. 1.

Referring to FIG. 5, when the door 11 is in its closed position a seal is provided between the bottom of the door and the lower cross member 29 of the frame by a conventional so-called flush invert assembly comprising a resiliently deformable sealing member 30 attached to the door and arranged to co-operate with the cross member 29 in sealing fashion.

Figure 3:
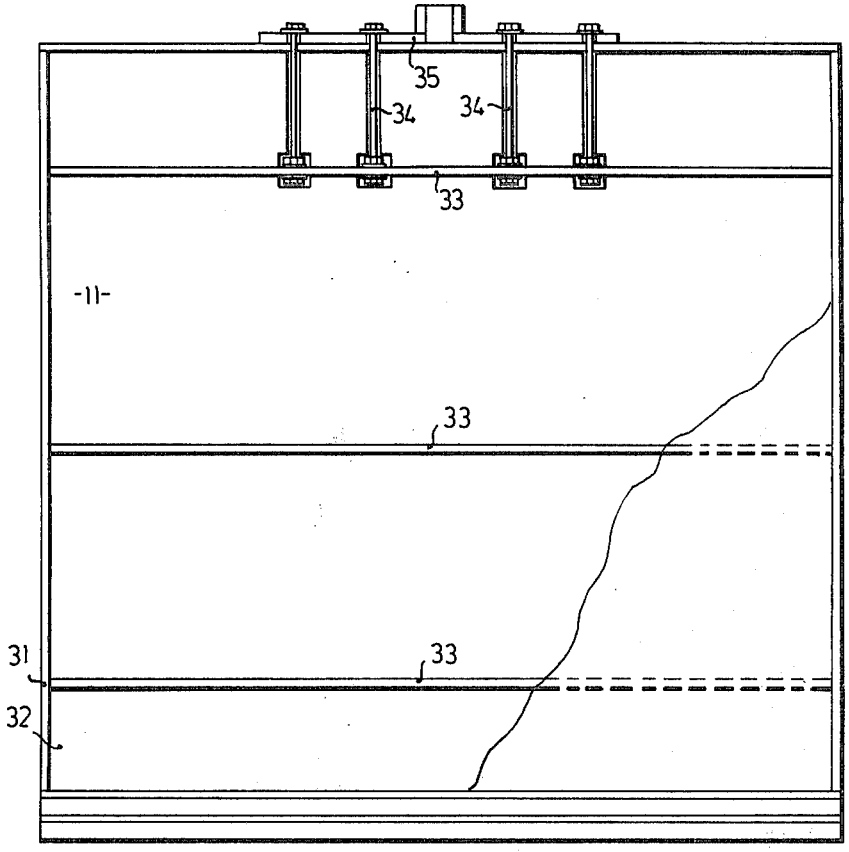
FIG. 3 is a front elevation, partly cut away, of the door of the sluice gate.

Referring to FIG. 3, the door comprises a reinforced polyvinylchloride skin 31 containing an expanded polyvinylchloride close cell foam filler 32 and horizontal metal reinforcing members 33. This construction makes the door light weight and not susceptible to corrosion and the skin 31 provides flat and smooth surfaces for engagement with the sealing faces of the sealing means. Embedded in the door and attached to the upper reinforcing member 33 are members 34 carrying an attachment plate 35 for the screw threaded spindle 18.

We claim:

1. In a sealing arrangement comprising two sealing members having respective sealing faces the mutual contact of which provides a seal between the members, and means operative between a fixed member and one of the sealing members to urge said one member towards the other sealing member thereby to press the sealing face of said one member into sealing engagement with the sealing face of said other member, the improvement wherein said means comprises two parts which are arranged to bear against or are connected to said one sealing member and said fixed member respectively and are movable relative to one another in a first direction to urge said one sealing member towards said other sealing member, one of the two parts comprising two spaced portions having the other part disposed between them with its side faces co-operating with the opposed faces of the two portions, at least one pair of said co-operating faces being planar faces disposed at an inclination to said first direction, and adjusting means operable to apply forces to the portions in directions towards one another and perpendicular or substantially perpendicular to said first direction, the said forces acting transversely through said faces, thereby to press the two portions inwardly against the intermediate part so that the two parts are moved relative to one another in said first direction under the effect of the co-operating inclined faces.

2. The improvement claimed in claim 1 wherein both said pairs of co-operating faces are at an inclination to said first direction, the intermediate part being of wedge form.

3. The improvement claimed in claim 1 wherein the said portions are arranged to bear against, the said one sealing member and are movable towards one another by the adjusting means and the intermediate part is fixed to said fixed member.

4. The improvement claimed in claim 1 wherein the intermediate part is arranged to bear against the said one sealing member and one of said portions is fixed to said fixed member, the other portion being movable towards said one portion by the adjusting means.

5. The improvement claimed in claim 1 wherein the adjusting means comprises a screw-threaded element extending through apertures in the said portions and the intermediate part and having a head or nut at one end engaged with one portion and a nut at the other end engaged with the other portion, whereby tightening of the latter nut urges said portions towards one another to cause the relative movement between said portions and said intermediate part.

6. The improvement claimed in claim 1 wherein the said other sealing member comprises a channel member having a base, two side walls extending from the base and flanges extending inwardly from the side walls towards one another; a sealing element mounted in the channel member for movement relative thereto in a direction perpendicular or substantially perpendicular to the base but being retained therein by the said flanges, said sealing element having a portion projecting from the mouth of the channel and providing the sealing face of the said other member; and resilient means disposed between the base of the channel member and the sealing element whereby, in use, the sealing element is resiliently urged outwardly by said resilient means to press its sealing face into engagement with the sealing face of the said one sealing member.

7. The improvement claimed in claim 6 wherein the said parts are of elongate form and a number of said adjusting means is provided at intervals along the parts, and the channel member and the sealing element are also of elongate form and are parallel to the said parts.

8. In a sluice gate comprising a frame to be mounted in or adjacent to an aperture or in a channel and defining an opening for the passage of liquid flowing through the aperture or along the channel, a door having means operable to move the door between a closed position in which sealing faces of the door and the frame are brought into sealing engagement thereby to close the opening and shut off the flow of liquid through the aperture or along the channel, and an open position in which the sealing faces are disengaged so that liquid is permitted to flow through the aperture or along the channel, and adjustable means for urging the door, when in its closed position, towards the frame thereby to press the sealing face of the door into sealing engagement with the sealing face of the frame, the improvement wherein said adjustable means comprises at least two parts of which one is arranged to bear against or is connected to the door and the other is fixed to the frame, the two parts being movable relative to one another in a first direction to urge the door towards the frame and having co-operating planar faces at an inclination to said first direction, and adjusting means operable to apply a force to said one part in a second direction perpendicular or substantially perpendicular to said first direction, said force acting transversely through said faces, to cause said one part to move in said first direction relative to said other, fixed part under the effect of the co-operating faces, thereby to urge the door towards the frame.

9. The improvement claimed in claim 8 wherein one of the two parts comprises two spaced portions having the other part disposed between them with its side faces co-operating with the opposed faces of the two portions, at least one pair of said co-operating faces being planar faces disposed at an inclination to said first direction, and the adjusting means is operable to apply forces to the two portions in directions towards one another and perpendicular or substantially perpendicular to said first direction, thereby to press the two portions inwardly against the intermediate part so that the two parts are moved relative to one another in said first direction under the effect of the inclined faces.

10. The improvement claimed in claim 9 wherein both said pairs of co-operating faces are at an inclination to said first direction, the intermediate part being of wedge form.

11. The improvement claimed in claim 9 wherein the said portions are arranged to bear against the door and are movable towards one another by the adjusting means and the intermediate part is fixed to the frame.

12. The improvement claimed in claim 9 wherein the intermediate part is arranged to bear against the door and one of said portions is fixed to the frame, the other portion being movable towards said one portion by the adjusting means.

13. The improvement claimed in claim 9 wherein the adjusting means comprises a screw-threaded element extending through apertures in the said portions and the intermediate part and having a head or nut at one end engaged with one portion and a nut at the other end engaged with the other portion, whereby tightening of the latter nut urges said portions towards one another to cause the relative movement between said portions and said intermediate part.

14. The improvement claimed in claim 8 wherein the frame is provided with a channel member having a base, two side walls extending from the base and flanges extending inwardly from the side walls towards one another; a sealing element mounted in the channel member for movement relative thereto in a direction perpendicular or substantially perpendicular to the base but being retained therein by the said flanges, said sealing element having a portion projecting from the mouth of the channel and providing the sealing face of the frame; and resilient means disposed between the base of the channel member and the sealing element whereby, in use, the sealing element is resiliently urged outwardly by said resilient means to press its sealing face into engagement with the sealing face of the door.

15. The improvement claimed in claim 14 wherein the said parts of the adjustable means are of elongate form and a number of said adjusting means is provided at intervals along the parts, and the channel member and the sealing element are also of elongate form and are parallel to the said parts.

16. The improvement claimed in claim 8 wherein a said adjustable means is provided at each side of the door, the said means being operable to urge the respective side portions of the door into sealing engagement with the frame.

* * * * *